US012372323B2

(12) United States Patent
McPherson et al.

(10) Patent No.: US 12,372,323 B2
(45) Date of Patent: Jul. 29, 2025

(54) CROSSBOW ARROW REST

(71) Applicant: MCP IP, LLC, Sparta, WI (US)

(72) Inventors: Mathew A. McPherson, Norwalk, WI (US); John R. Scovil, Scottsdale, AZ (US); Mark J. Hayes, Onalaska, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 18/595,218

(22) Filed: Mar. 4, 2024

(65) Prior Publication Data

US 2024/0240908 A1 Jul. 18, 2024

Related U.S. Application Data

(63) Continuation of application No. 17/589,613, filed on Jan. 31, 2022, now Pat. No. 11,920,892, which is a continuation of application No. 16/776,354, filed on Jan. 29, 2020, now Pat. No. 11,236,962.

(60) Provisional application No. 62/798,399, filed on Jan. 29, 2019.

(51) Int. Cl.

| | |
|---|---|
| ***F41B 5/12*** | (2006.01) |
| ***F41B 5/14*** | (2006.01) |
| ***F41B 5/22*** | (2006.01) |

(52) U.S. Cl.

CPC ..... *F41B 5/12* (2013.01); *F41B 5/143* (2013.01)

(58) Field of Classification Search

CPC ..... F41B 5/12; F41B 5/143

See application file for complete search history.

(56) References Cited

U.S. PATENT DOCUMENTS

| | | | | |
|---|---|---|---|---|
| 4,722,318 | A * | 2/1988 | Yankey | F41B 5/123 124/44.5 |
| 4,827,893 | A * | 5/1989 | Nishioka | F41B 5/12 473/578 |
| 5,119,717 | A * | 6/1992 | Yasutome | F16H 61/30 91/361 |
| 6,267,108 | B1 | 7/2001 | McPherson et al. | |
| 6,688,297 | B1 | 2/2004 | Clague | |
| 7,328,693 | B2 | 2/2008 | Kempf | |
| 7,810,480 | B2 | 10/2010 | Shepley et al. | |
| 7,823,572 | B2 | 11/2010 | Anderson | |
| 7,891,348 | B2 | 2/2011 | Colley | |
| 7,963,279 | B2 | 6/2011 | Harwath et al. | |
| 7,997,258 | B2 | 8/2011 | Shepley et al. | |
| 8,091,540 | B2 | 1/2012 | Matasic et al. | |
| 8,453,631 | B1 | 6/2013 | Kronengold et al. | |
| 8,529,383 | B2 | 9/2013 | Donahoe | |
| 8,671,923 | B2 | 3/2014 | Goff et al. | |
| 8,931,465 | B1 | 1/2015 | Choma | |
| 9,022,013 | B2 | 5/2015 | Trpkovski | |
| 9,441,925 | B1 | 9/2016 | Palomaki et al. | |
| 9,494,379 | B2 | 11/2016 | Yehle | |

(Continued)

*Primary Examiner* — John A Ricci

(74) *Attorney, Agent, or Firm* — Laabs Intellectual Property

(57) ABSTRACT

In some embodiments, a crossbow comprises a frame, a bow portion comprising a bowstring, a latch and a trigger. An arrow rest is supported by the frame at a first location. The frame is also arranged to support the arrow rest at a second location. A distance between the latch and the first location is different from a distance between the latch and the second location.

20 Claims, 19 Drawing Sheets

(56) References Cited

U.S. PATENT DOCUMENTS

| | | | |
|---|---|---|---|
| 9,494,380 | B1 | 11/2016 | Yehle |
| 9,599,426 | B2 | 3/2017 | Darlington |
| 10,175,022 | B2 | 1/2019 | Barnett |
| 10,184,741 | B2 | 1/2019 | Roberts et al. |
| 10,184,749 | B2 | 1/2019 | Trpkovski |
| 10,209,028 | B2 | 2/2019 | Bofill |
| 10,240,890 | B2 | 3/2019 | Trpkovski |
| 10,415,924 | B1 | 9/2019 | Huang |
| 11,236,962 | B2 | 2/2022 | McPherson et al. |
| 11,920,892 | B2 | 3/2024 | McPherson et al. |

* cited by examiner

CROSSBOW ARROW REST

CROSS-REFERENCE TO RELATED APPLICATIONS

This application claims the benefit of U.S. patent application Ser. No. 17/589,613, filed Jan. 31, 2022, which claims the benefit of U.S. patent application Ser. No. 16/776,354, filed Jan. 29, 2020, which claims the benefit of U.S. Patent Application No. 62/798,399, filed Jan. 29, 2019, the entire content of each of which is hereby incorporated herein by reference.

BACKGROUND OF THE INVENTION

This invention relates generally to crossbows and more specifically to arrow support in a crossbow. Crossbows are generally known in the art and are used to launch projectiles, such as an arrow or bolt.

Arrows are available in a variety of different sizes, materials, weights, etc. An archer may desire to use different types of arrows with the same crossbow. When using a traditional crossbow with a fixed arrow support, using arrows with different specifications can produce unpredictable results. For example, a crossbow might have high accuracy when using a first arrow specification but have poor accuracy when using a second arrow specification.

There remains a need for novel crossbow designs that are a capable of maintaining a desired accuracy level when using different arrow specifications.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

In some embodiments, crossbow comprises a frame, a bow portion comprising a bowstring, a latch and a trigger. An arrow rest is supported by the frame at a first location. The frame is also arranged to support the arrow rest at a second location. A distance between the latch and the first location is different from a distance between the latch and the second location.

In some embodiments, the first location comprises a first aperture and the second location comprising a second aperture. In some embodiments, an aperture comprises helical threads.

In some embodiments, the arrow rest comprises a first support member and a second support member. In some embodiments, the arrow rest comprises a body member arranged to support the first support member and the second support member. In some embodiments, the arrow rest comprises a bracket arranged to support the body member and the bracket is arranged to contact the frame. In some embodiments, the body member is arranged to extend through an aperture in the frame.

In some embodiments, the frame comprises a groove. In some embodiments, the groove comprises a first portion having a first width and a second portion having a second width, and the arrow rest attachment locations are oriented in the second portion of the groove.

In some embodiments, the crossbow comprises a clamping fastener arranged to elastically deform a portion of the frame and the arrow rest is formed integrally in the frame adjacent to the clamping fastener. In some embodiments, a clamping fastener comprises a screw and a nut.

In some embodiments, the frame comprises a groove and the arrow rest comprises a first fastener and a second fastener arranged on opposite sides of the groove. In some embodiments, the first location comprises a first aperture and a second aperture arranged on opposite sides of the groove, wherein the first fastener is engaged with the first aperture and the second fastener is engaged with the second aperture.

In some embodiments, an arrow rest comprises a body comprising a base, a first support member and a second support member, and the base comprises a central aperture. In some embodiments, the frame comprises a supporting surface arranged to contact the base. In some embodiments, the base is arranged to self-center on the supporting surface. In some embodiments, the base and the supporting surface comprise complimentary V-shaped surfaces.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF DRAWINGS

A detailed description of the invention is hereafter described with specific reference being made to the drawings.

DETAILED DESCRIPTION OF THE INVENTION

Figure 1:
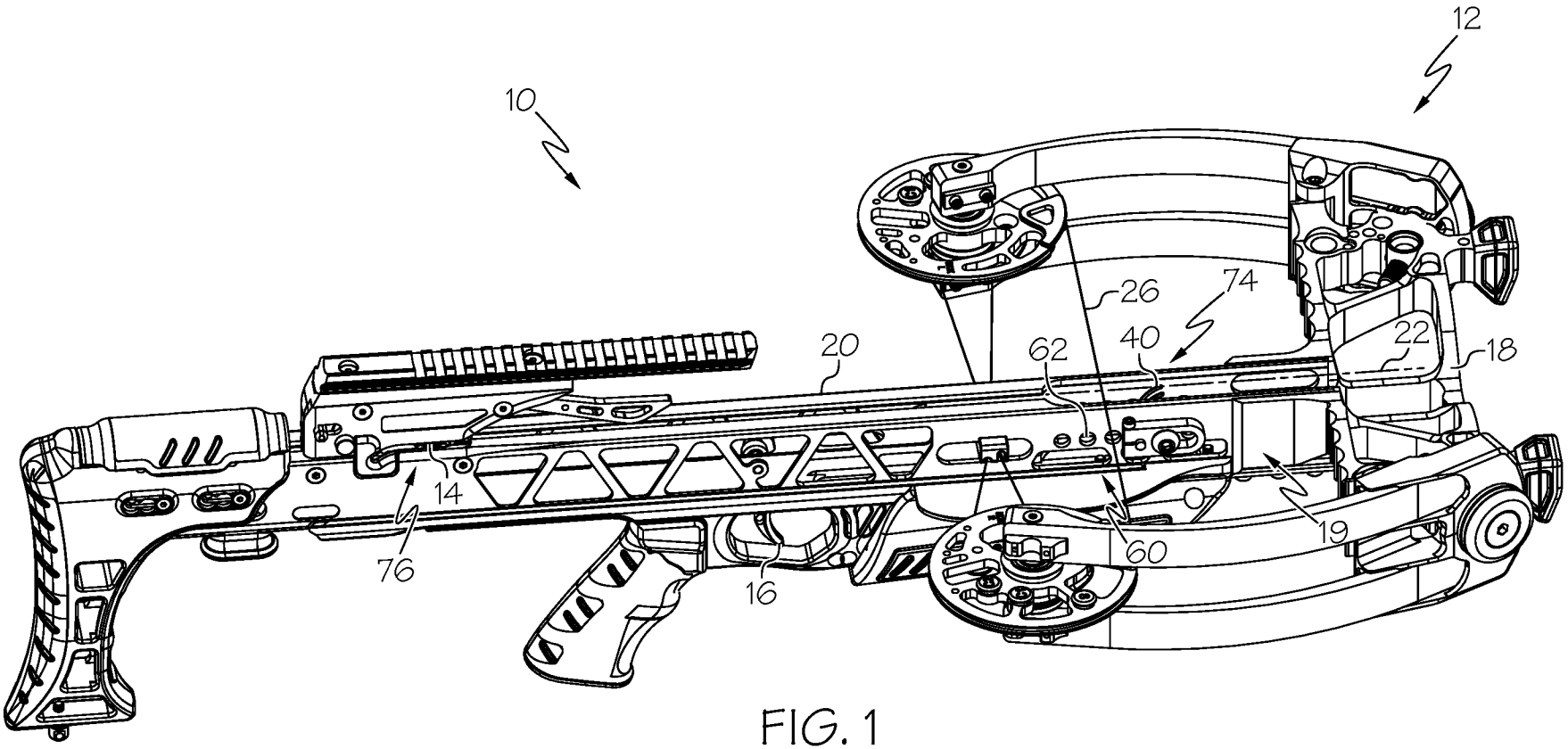
FIG. 1 shows an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 10. In some embodiments, a crossbow 10 comprises components as described in US 2018/0224237, the entire disclosure of which is hereby incorporated herein by reference.

In some embodiments, a crossbow 10 comprises a bow portion 12, a rail 20, a prod 18 attaching the bow portion 12 to the rail 20, a string latch 14 and a trigger 16. Desirably, the bow portion 12 comprises limbs and a bowstring 26. In some embodiments, the string latch 14 is arranged to retain the bowstring 12 in a cocked orientation and the trigger 16 is arranged to release the string latch 14 and cause the crossbow 10 to fire. In some embodiments, the bow portion 12 comprises a compound bow, for example comprising rotating members and one or more power cables. In some embodiments, the prod 18 is a structural component of the crossbow 10 that attaches limbs to the rail 20. In some embodiments, the crossbow 10 comprises a structural frame 19. In some embodiments, the frame 19 comprises the rail 20 and the prod 18. Desirably, the crossbow 10 defines a shooting axis 22.

Desirably, the crossbow 10 comprises an arrow rest 40. In some embodiments, the arrow rest 40 is arranged to support an arrow. In some embodiments, the crossbow 10 supports an arrow at two locations. In some embodiments, the crossbow 10 supports an arrow at the bowstring 26 near the latch 14 in the drawn/cocked orientation. In some embodiments, the crossbow 10 supports an arrow at the arrow rest 40. In some embodiments, the arrow rest 40 comprises a front arrow support location.

In some embodiments, the arrow rest 40 is repositionable on the crossbow 10. In some embodiments, the arrow rest 40 is attached to the frame 19. In some embodiments, the arrow rest 40 is attached to the rail 20. In some embodiments, the arrow rest 40 is repositionable on the crossbow 10 between a plurality of attachment orientations. In some embodiments, the arrow rest 40 is repositionable on the crossbow 10 between a plurality of attachment locations 60. In some embodiments, the arrow rest 40 can be moved along a length of the crossbow 10. In some embodiments, an arrow rest 40 is moveable between a first position and a second position with respect to the rail 20. In some embodiments, the first position and second position comprise different attachment locations 60 along the length of the rail 20. In some embodiments, the first position and second position comprise different attachment locations 60 that are spaced along the length of the shooting axis 22, which may be located at different distances from the latch 14.

In some embodiments, an arrow rest 40 comprises a fixed arrow rest, for example comprising parts that do not move with respect to the crossbow 10 as the arrow is launched from the crossbow 10.

In some embodiments, a plurality of predetermined attachment locations 60 are provided along the length of the rail 20. In some embodiments, a spacing between adjacent attachment locations 60 is constant. In some embodiments, an attachment location comprises an aperture 62.

Figure 2:
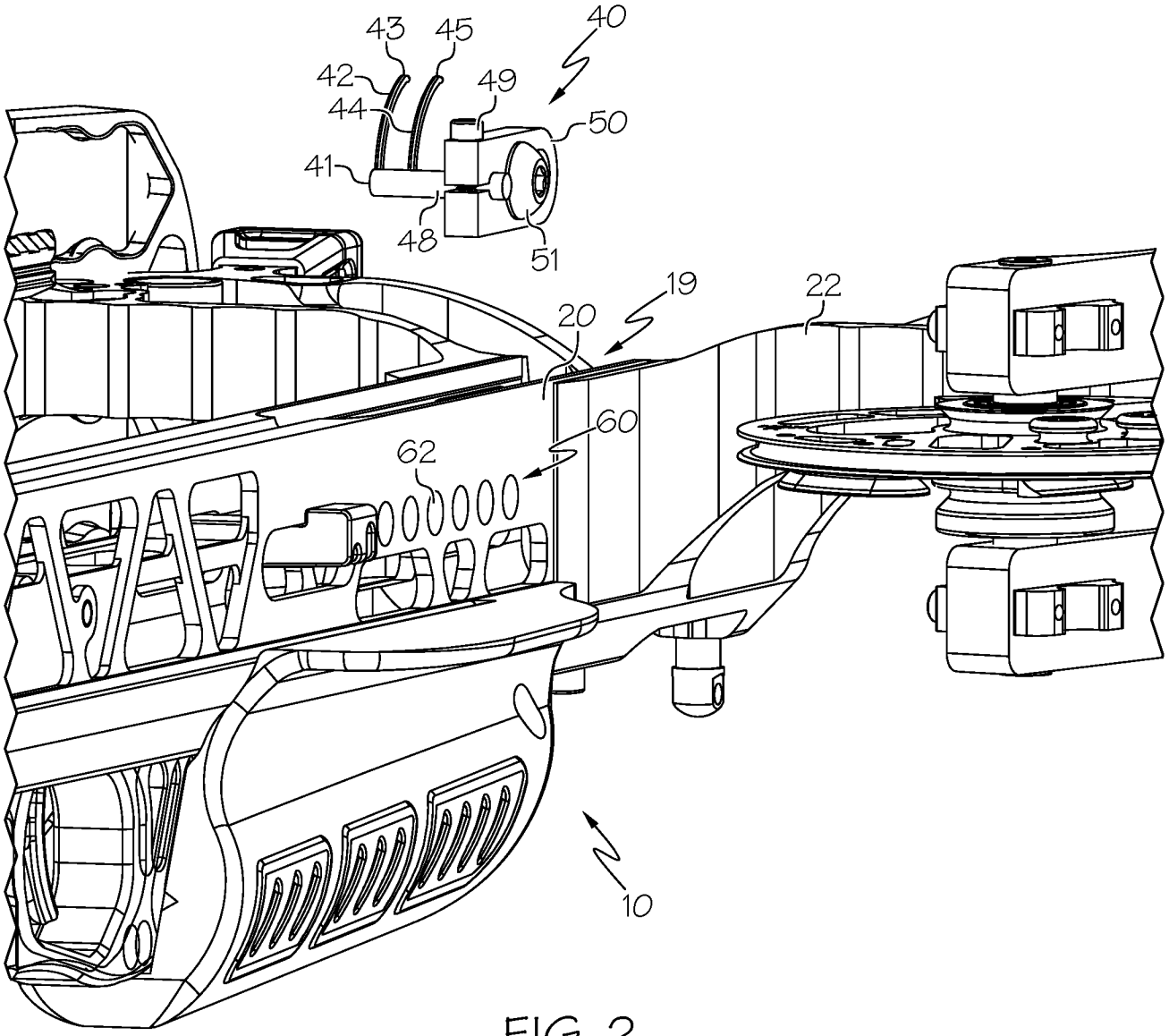
FIG. 2 shows an embodiment of a crossbow and an embodiment of an arrow rest.
Figure 3:
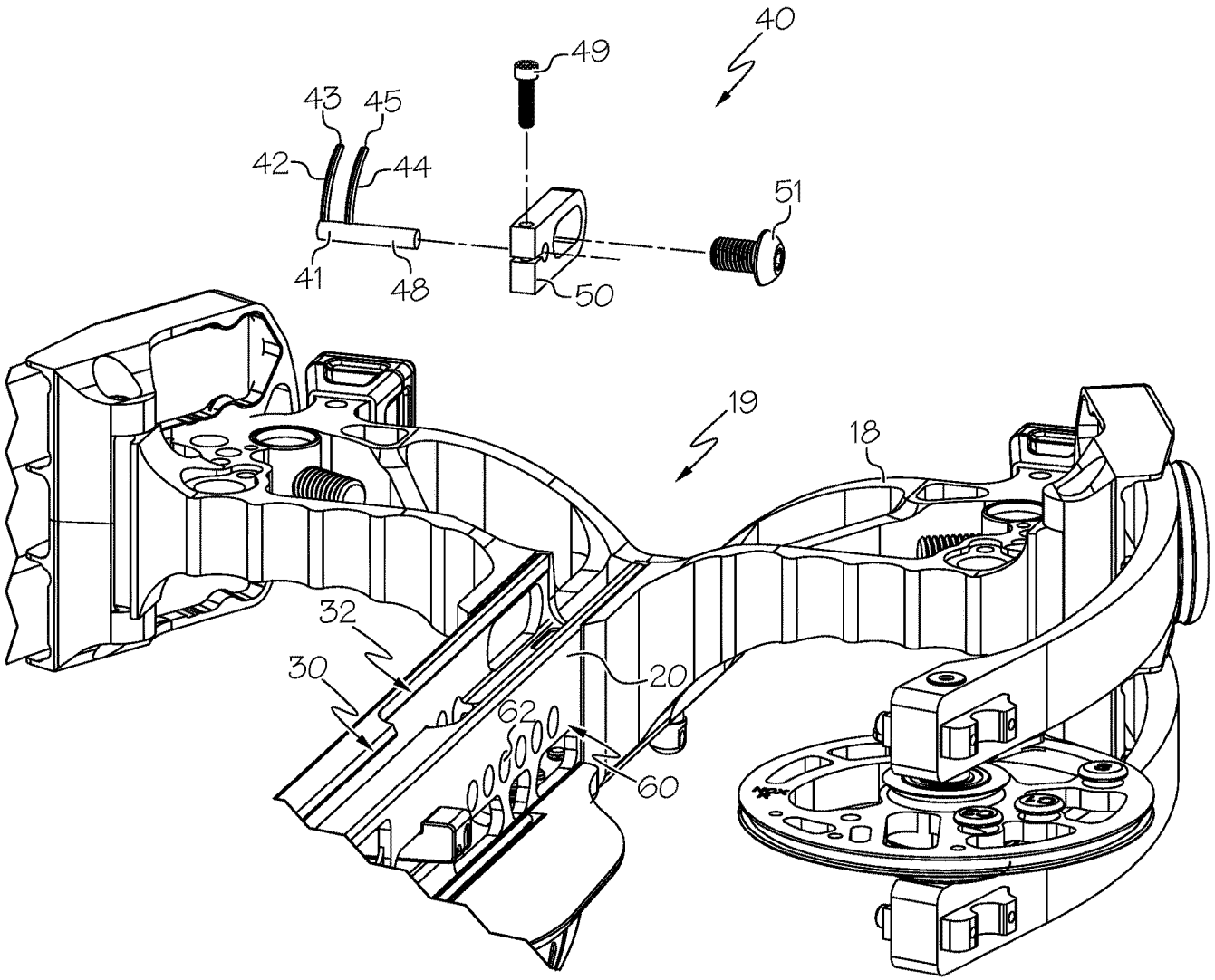
FIG. 3 shows an exploded view of the arrow rest of FIG. 2.

FIG. 2 shows the crossbow 10 of FIG. 1 with an embodiment of an arrow rest 40 removed. FIG. 3 shows an exploded view of the embodiment of the arrow rest 40. In some embodiments, an arrow rest 40 comprises a body member 41 comprising a first support member 42 and a second support member 44.

In some embodiments, the first support member 42 and a second support member 44 are shaped similarly to one another. In some embodiments, the first support member 42 and the second support member 44 comprise an elongate, curved shape. In some embodiments, the first support member 42 and the second support member 44 are spaced apart from one another, for example to provide a gap for arrow fletching. In some embodiments, the body member 41 comprises a shaft 48 and the support members 42, 44 extend from the shaft 48. In some embodiments, the support members 42, 44 collectively support an arrow. In some embodiments, the first support member 42 comprises a first supporting surface 43 arranged to contact an arrow and the second support member 44 comprises a second supporting surface 45 arranged to contact the arrow. In some embodiments, a distance between the shaft 48 and the supporting surfaces 43, 45 comprises a spacing to allow arrow fletching to pass.

In some embodiments, the arrow rest 40 comprises a bracket 50. In some embodiments, a bracket 50 is used to attach the body member 41 to the crossbow 10. In some embodiments, the body member 41 is received in the bracket 50. In some embodiments, the bracket 50 is attached to the rail 20 by a fastener 51. In some embodiments, the fastener 51 engages an attachment location 60. In some embodiments, the fastener 51 engages an aperture 62. In some embodiments, the arrow rest 40 can be moved by attaching the fastener 51 to different apertures 62. In some embodiments, each attachment location 60 comprises an aperture 62 comprising helical threads.

In some embodiments, the body member 41 comprises a shaft 48. In some embodiments, the shaft 48 comprises a non-circular cross-sectional shape and the bracket 50 comprises a non-circular receptacle. In some embodiments, the shaft 48 is attachable to the bracket 50 in only one orientation, and the orientation of the support members 42, 44 with respect to the bracket 50 is not adjustable. In some embodiments, the shaft 48 comprises a circular cross-sectional shape and the bracket 50 comprises a circular receptacle. In some embodiments, the body member 41 is moveable with respect to the bracket 50. In some embodiments, the shaft 48 comprises a central axis and the body member 41 is rotatable about the central axis with respect to the bracket 50. In some embodiments, the bracket 50 comprises an adjustment screw 49 that is used to set the orientation of the body member 41 with respect to the bracket 50.

In some embodiments, at least a portion of the arrow rest 40 is oriented within the rail 20. In some embodiments, at least a portion of the body member 41 is oriented within the rail 20. In some embodiments, the rail 20 comprises a groove 30 that extends along the length of the rail 20. In some embodiments, the groove 30 provides clearance for an arrow. In some embodiments, the groove 30 comprises an enlarged portion 32, for example near the front portion of the rail 20. In some embodiments, the attachment locations 60 and enlarged portion 32 overlap along the length of the rail 20. In some embodiments, at least a portion of the arrow rest 40 is oriented in the enlarged portion 32. In some embodiments, the enlarged portion 32 provides clearance for the arrow rest 40.

Figure 4:
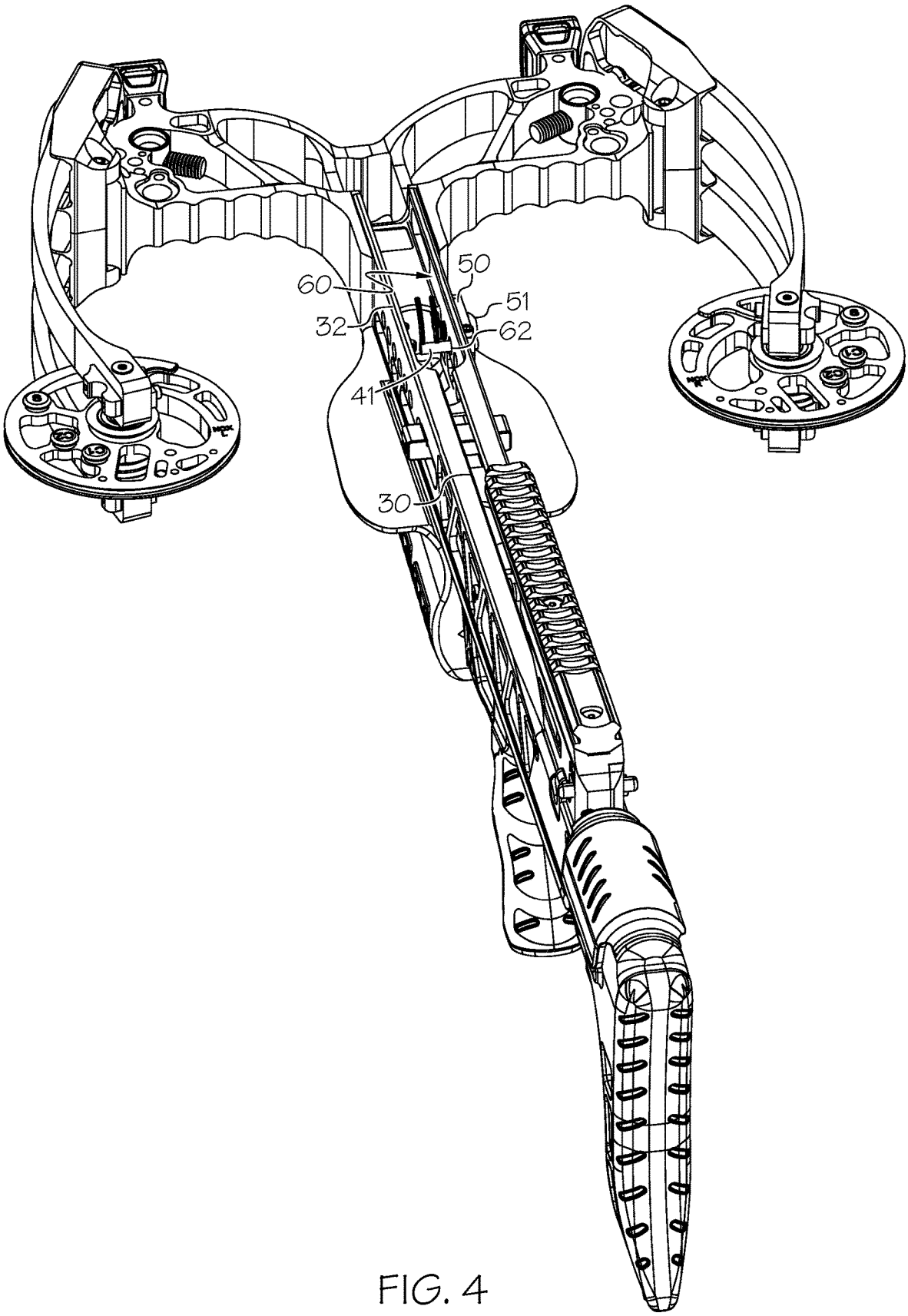
FIG. 4 shows another view of the crossbow of FIG. 1.
Figure 5:
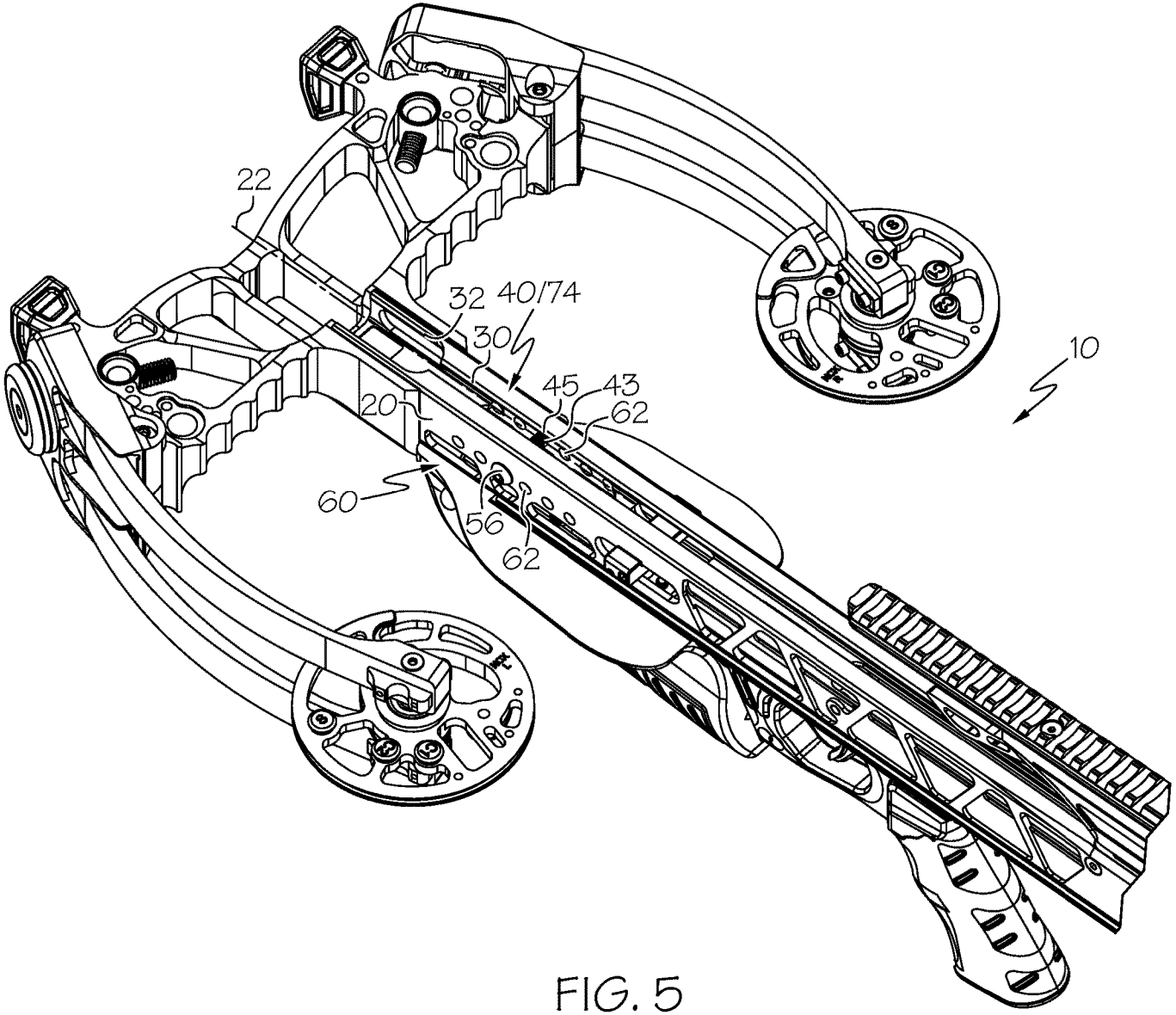
FIGS. 5 and 6 show views of another embodiment of a crossbow.
Figure 6:
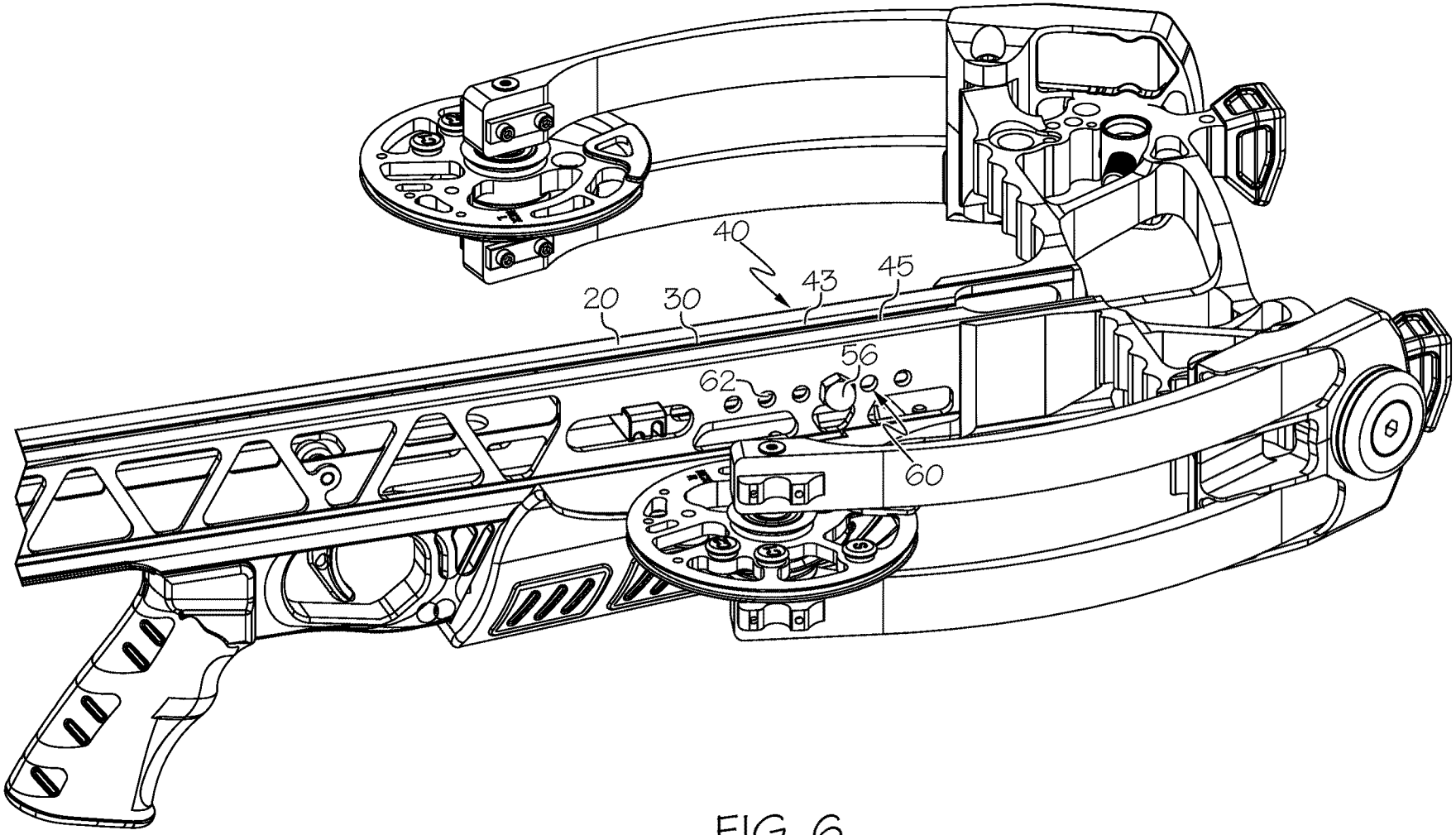
Figure 7:
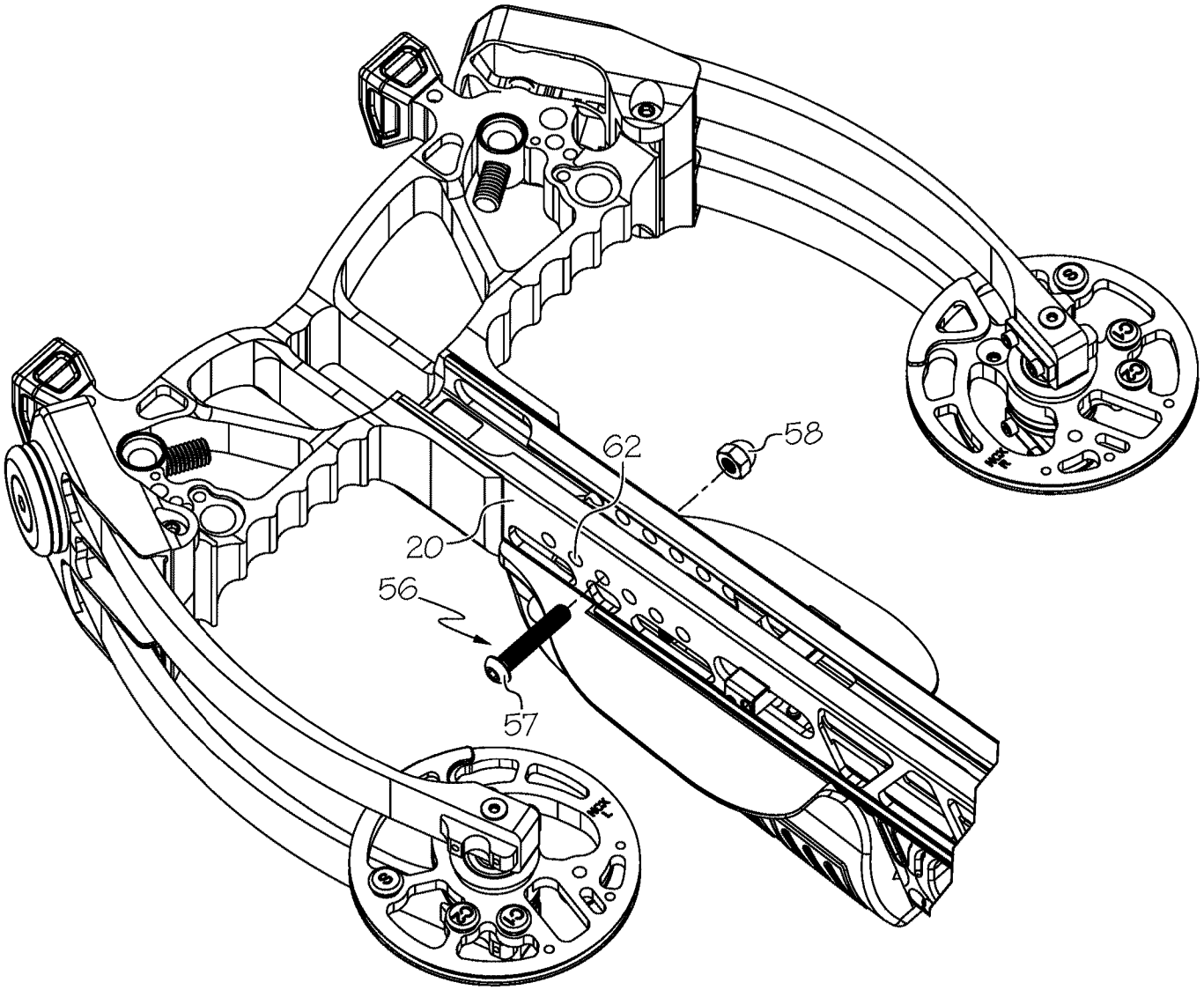
FIGS. 7 and 8 shows the crossbow of FIG. 5 with an exploded view of a clamping fastener.
Figure 8:
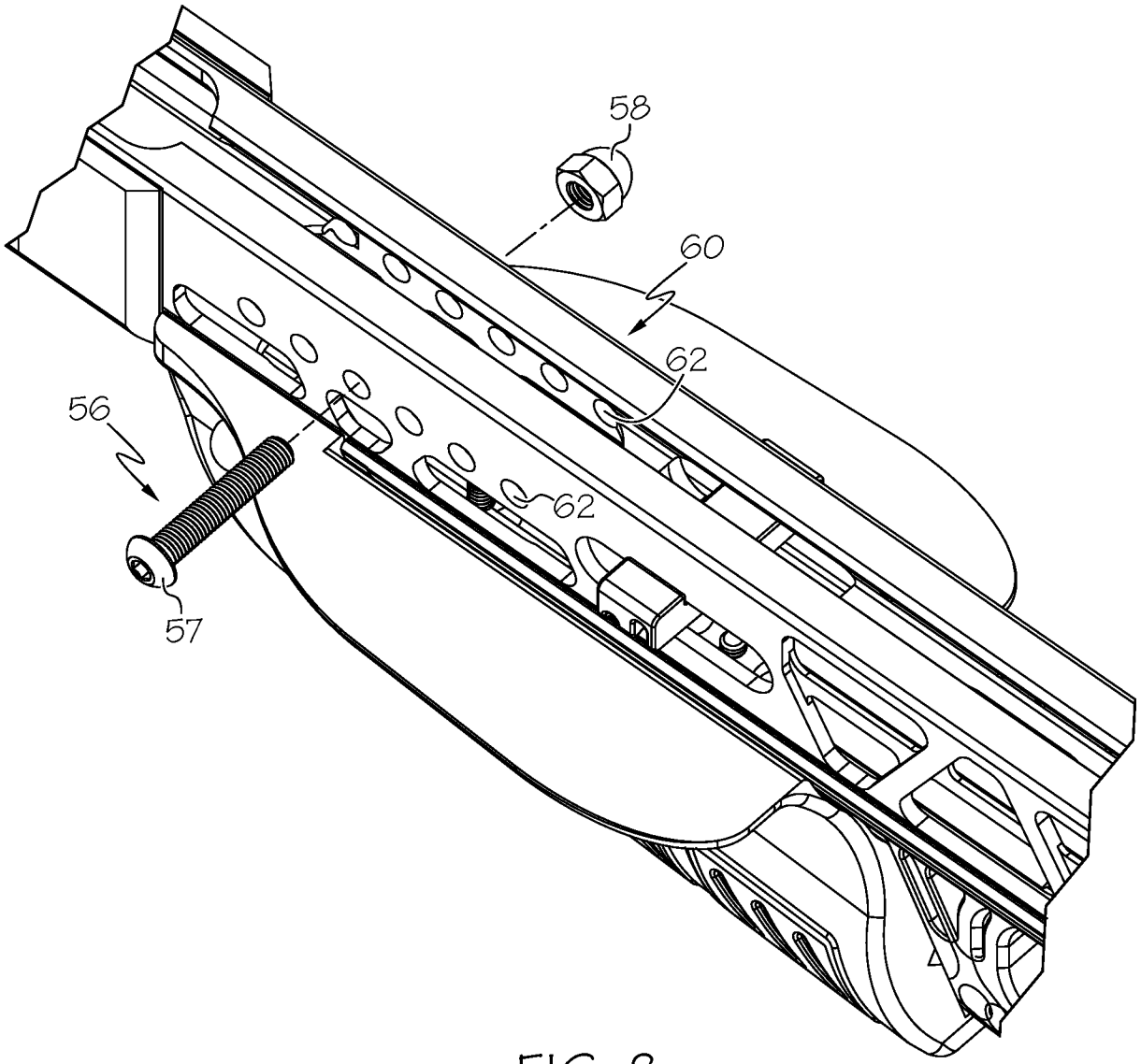

FIG. 4 shows another view of the embodiment of a crossbow of FIG. 1. In some embodiments, a portion of the body member 41 extends through an aperture 62 in the rail 20. In some embodiments, the shaft 48 extends through an aperture 62 in the rail 20. In some embodiments, the fastener 51 attaches the arrow rest 40 to one aperture 62 and the body member 41 extends through an adjacent aperture 62. In some embodiments, pairs of apertures 62 are provided along the length of the rail 20. In some embodiments, the arrow rest 40 can be repositioned between adjacent apertures 62 along the length of the rail 20.

FIGS. 5-8 show another embodiment of a crossbow 10. In some embodiments, the rail 20 comprises an integral arrow rest 40. In some embodiments, the rail 20 comprises an arrow support location 74 and comprises a first supporting surface 43 and a second supporting surface 45. In some embodiments, a clamping fastener 56 is attached to the rail 20. In some embodiments, the clamping fastener 56 applies forces to the rail 20 that elastically deform the rail 20. In some embodiments, a distance across the groove 30 at the arrow support location 74 is reduced slightly due to elastic deformation of the rail 20. In some embodiments, the supporting surfaces 43, 45 are aligned with the clamping fastener 56.

In some embodiments, the rail 20 comprises a plurality of attachment locations 60 suitable for a clamping fastener 56. In some embodiments, an attachment location 60 comprises a pair of apertures 60 aligned with one another on opposing sides of the shooting axis 22.

In various embodiments, a clamping fastener 56 can provide any suitable amount of deformation to the rail 20. In some embodiments, the rail 20 is elastically deformed such that the supporting surfaces 43, 45 near the clamping fastener 56 support an arrow, but the arrow does not contact the rail 20 at locations spaced away from the clamping fastener 56. In some embodiments, a clamping fastener 56 provides a few thousands of an inch of deflection, or more. In some embodiments, a clamping fastener 56 provides between 1/1000 and 10/1000 of an inch of deflection.

In some embodiments, a clamping fastener 56 comprises a bolt 57 and a nut 58. In some embodiments, a nut 58 comprises a cap nut. In some embodiments, the bolt 57 abuts a first side of the rail 20 and the nut 58 abuts a second side of the rail 20.

Figure 9:
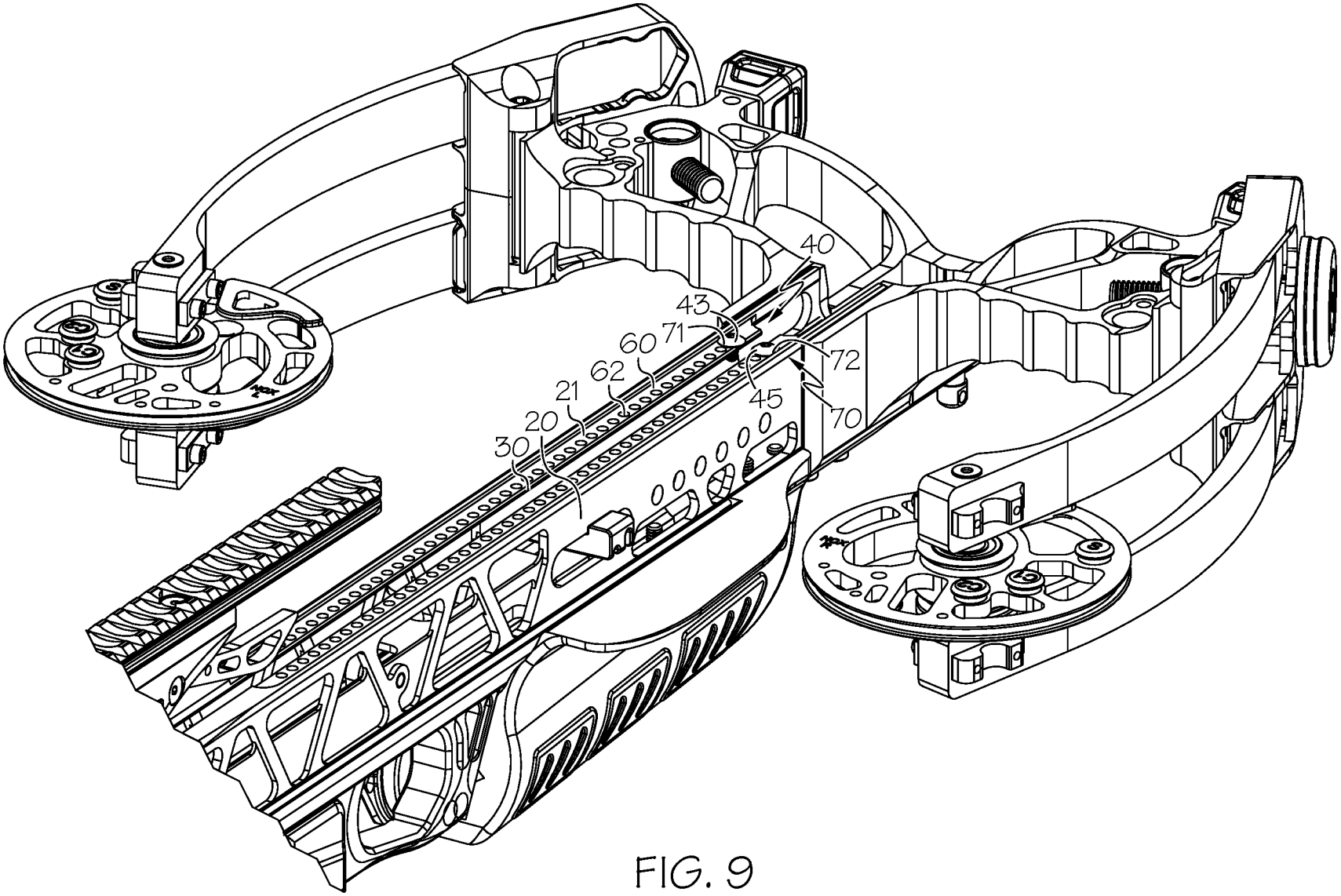
FIG. 9 shows another embodiment of a crossbow.
Figure 10:
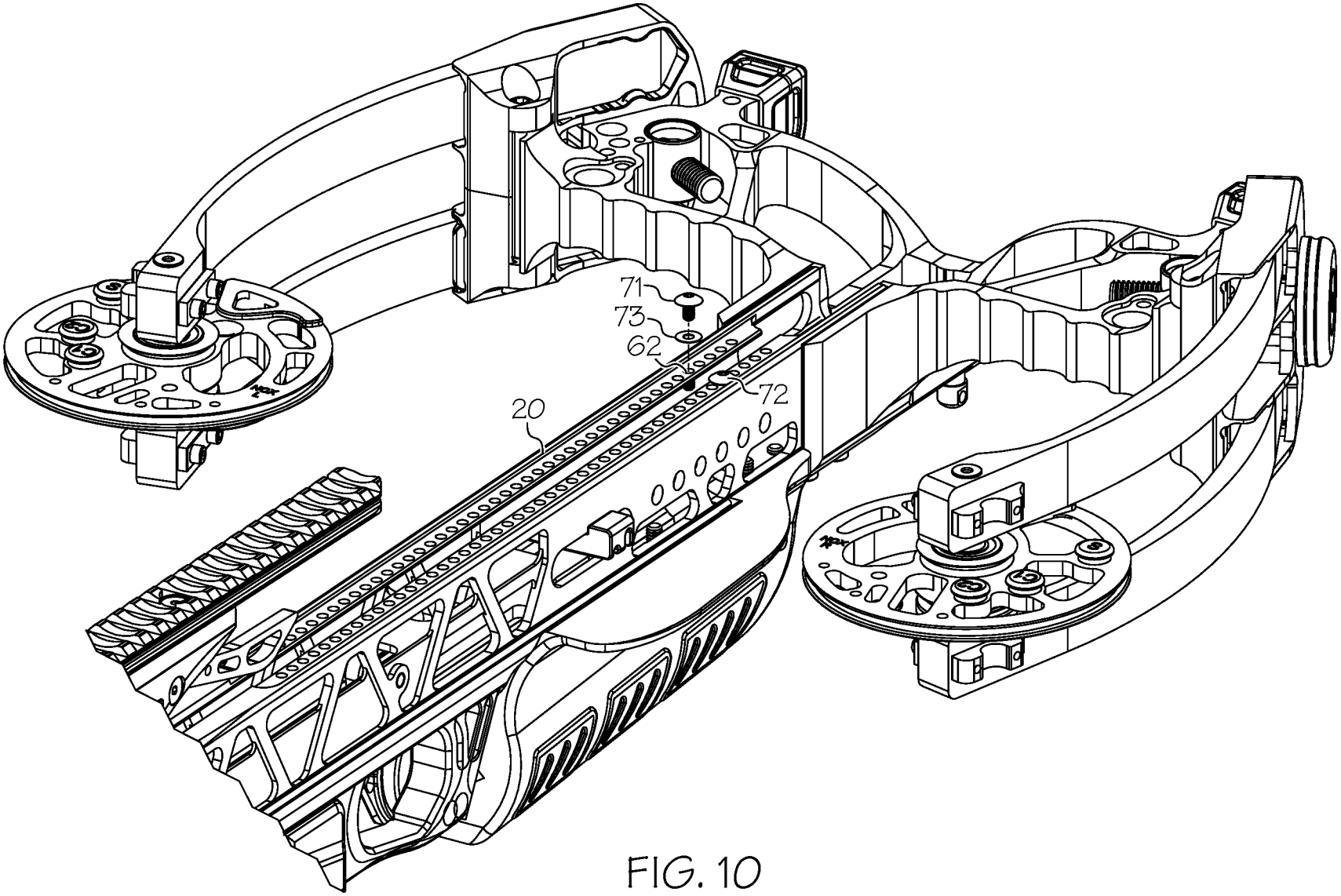
FIG. 10 shows the crossbow of FIG. 9 with a portion of an arrow rest removed.
Figure 11:
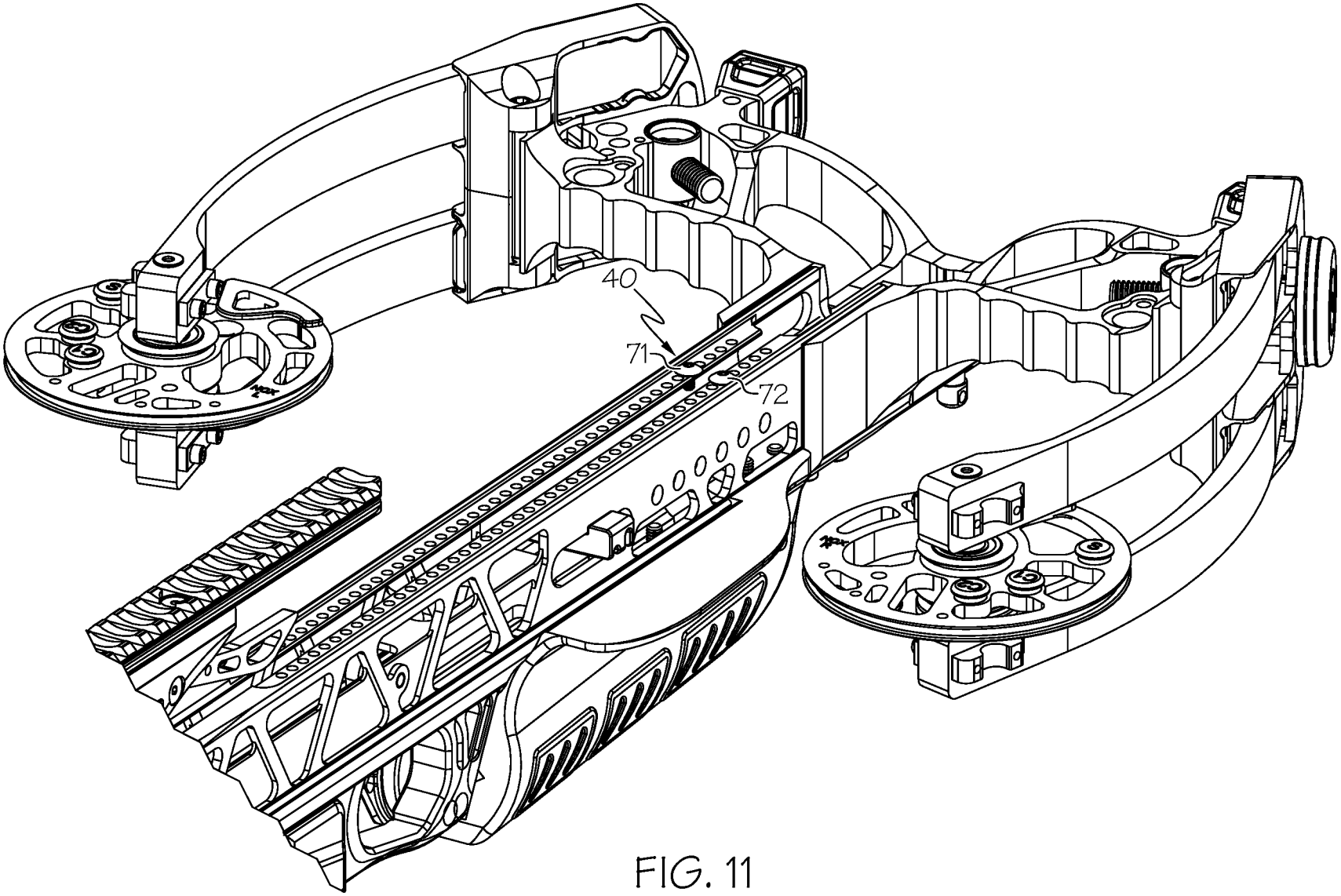
FIG. 11 shows the crossbow of FIG. 9 with an arrow rest in an alternative location.

FIGS. 9-11 show another embodiment of a crossbow 10. In some embodiments, an arrow rest 40 comprises a pair of support members 70 engaged with the rail 20. In some embodiments, the pair of support members 70 comprise a first fastener 71 and a second fastener 72. In some embodiments, the first fastener 71 comprises a first supporting surface 43 and the second fastener 72 comprises a second supporting surface 45.

In some embodiments, a plurality of attachment locations 60 are provided along the length of the rail 20. In some embodiments, an attachment location 60 comprises a pair of apertures 62 located on opposite sides of the groove 30. In some embodiments, an attachment location 60 comprises a pair of apertures 62 located on opposite sides of the shooting axis 22. In some embodiments, a rail 20 comprises a top flange 21 that defines the groove 30, and the apertures 62 are formed in the top flange 21.

In some embodiments, the fasteners 71, 72 comprise screws arranged to engage the apertures 62. In some embodiments, the apertures 62 comprise helical threads.

In some embodiments, a height of a fastener 71, 72 can be adjusted by using a spacer 73 between the fastener 71, 72 and the rail 20. In some embodiments, a spacer 73 comprises a washer. The size of a spacer can be adjusted as desired.

FIG. 11 shows an arrow rest 40 comprising a pair of support members 70 attached to an attachment location 60 that is different from the attachment location 60 shown in FIG. 9.

Figure 12:
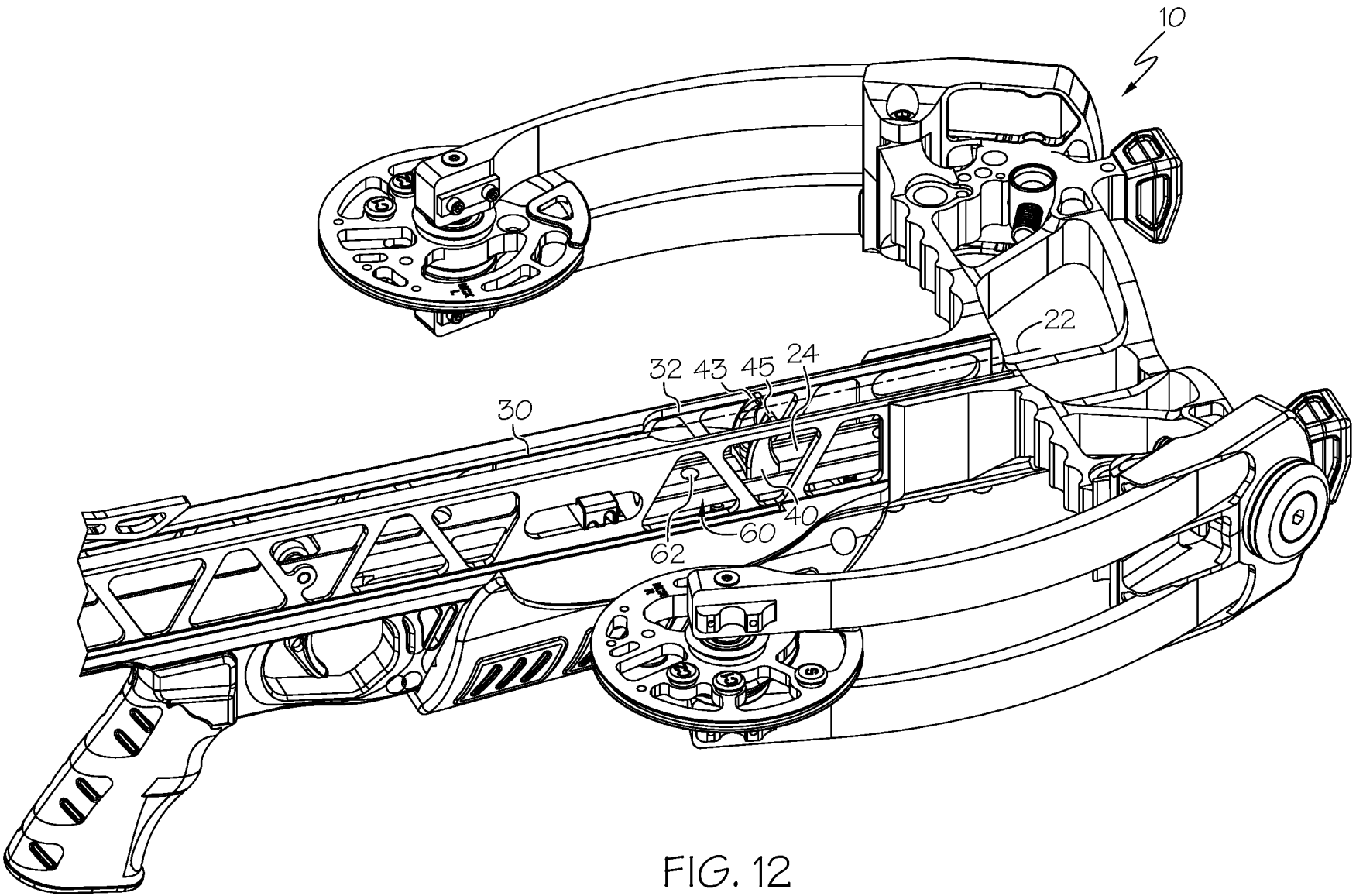
FIG. 12 shows another embodiment of a crossbow with another embodiment of an arrow rest.

FIG. 12 shows another embodiment of a crossbow 10. In some embodiments, an arrow rest 40 comprises a body member 41 positioned in the rail 20. In some embodiments, the rail 20 comprises a supporting surface 24 arranged to support the arrow rest 40. In some embodiments, the supporting surface 24 extends parallel to the shooting axis 22. In some embodiments, the supporting surface 24 comprises a plurality of attachment locations 60. In some embodiments, an attachment location 60 comprises an aperture 62. In some embodiments, the supporting surface 24 comprises a plurality of apertures 62 spaced along a length of the rail 20.

Figure 13:
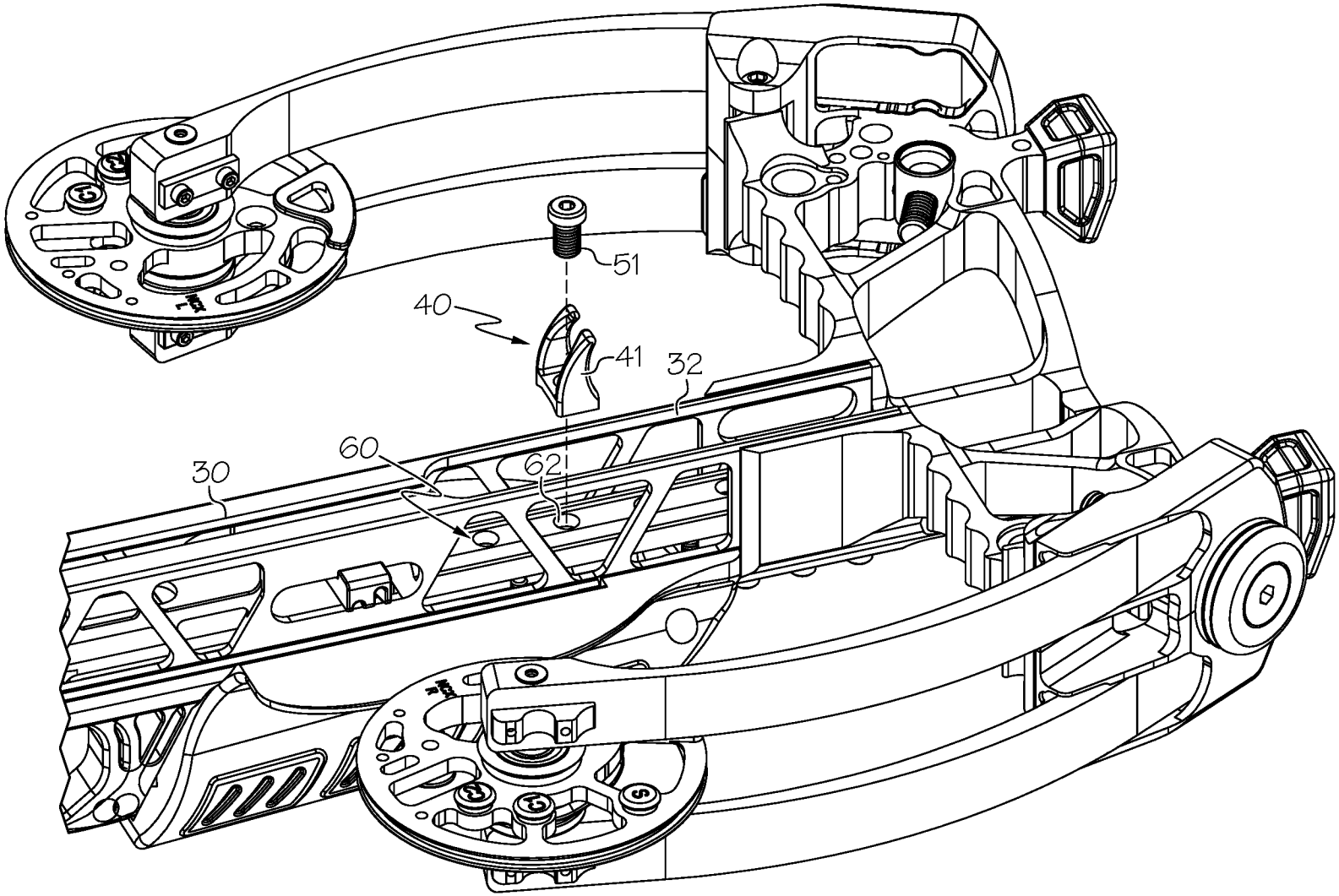
FIGS. 13 and 14 show the crossbow of FIG. 12 with an exploded view of the embodiment of the arrow rest.
Figure 14:
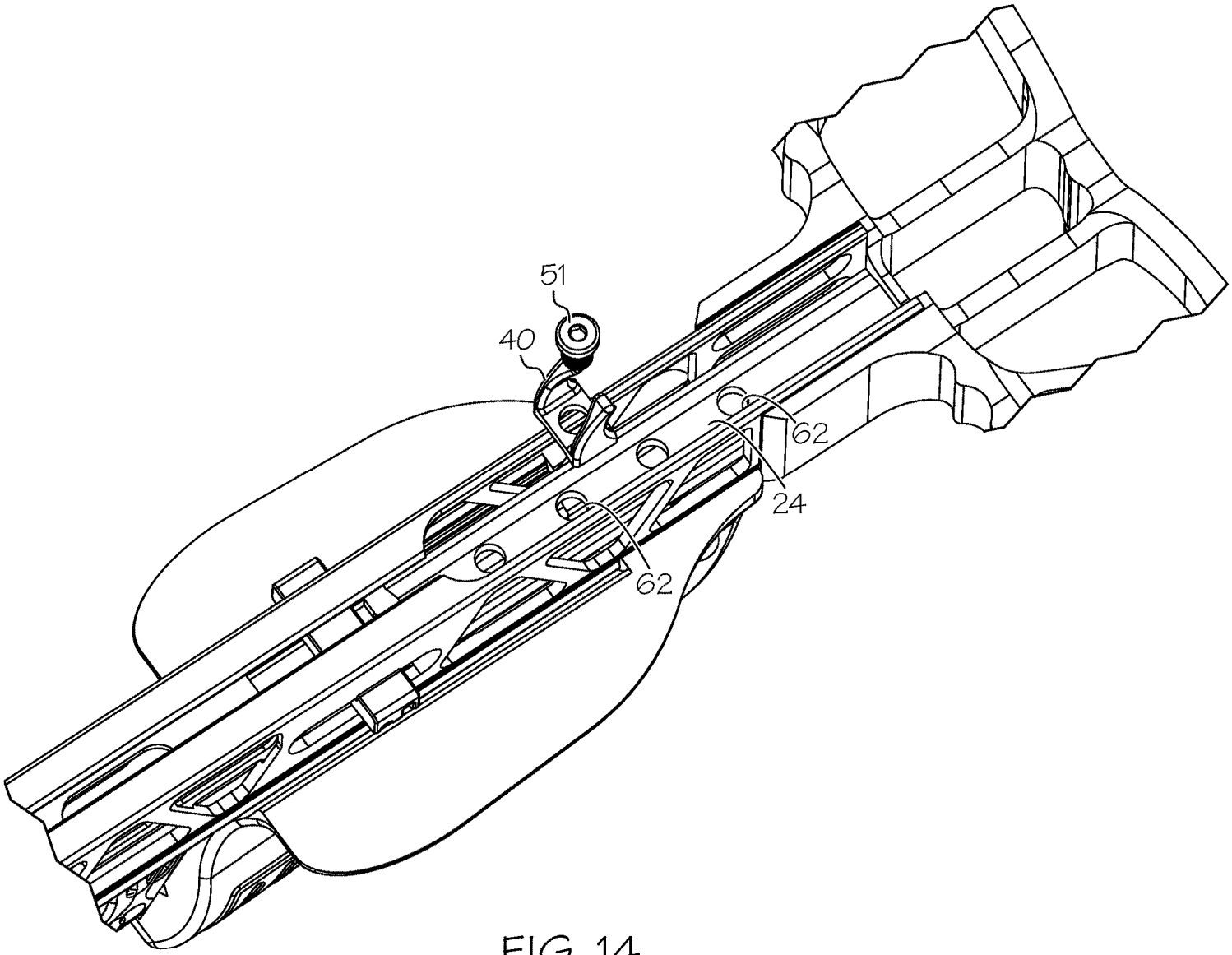
Figure 15:
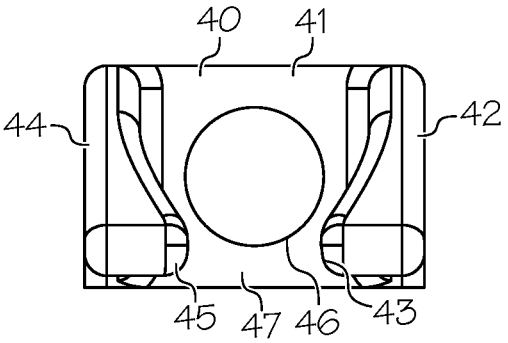
FIGS. 15-18 show different views of an embodiment of an arrow rest.
Figure 16:
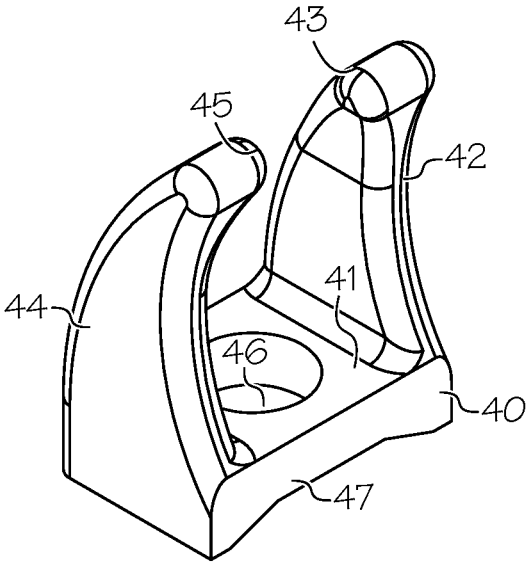

FIGS. 13 and 14 show views of the embodiment of FIG. 12 with the arrow rest 40 removed. An embodiment of a support surface 24 is shown from multiple angles.

In some embodiments, the arrow rest 40 is repositionable between a plurality of attachment locations 60 defined on the supporting surface 24.

In some embodiments, a fastener 51 attaches the arrow rest 40 to the supporting surface 24. In some embodiments, a fastener 51 engages an aperture 62.

FIGS. 15-18 show different views of an embodiment of an arrow rest 40. In some embodiments, an arrow rest 40 comprises a body member 41 comprising a base 47, a first support member 42 and a second support member 44. In some embodiments, the base 47 comprises an aperture 46 arranged to receive a fastener. In some embodiments, the aperture 46 is located between the first support member 42 and the second support member 44. In some embodiments, the support members 42, 44 comprise contoured shapes and orient the supporting surfaces 43, 45 offset from the aperture 46, which allows a fastener to fit between the supporting surfaces 43, 45 for installation. In some embodiments, the supporting surfaces 43, 45 comprise inwardly extending flange portions of the support members 42, 44.

Figure 17:
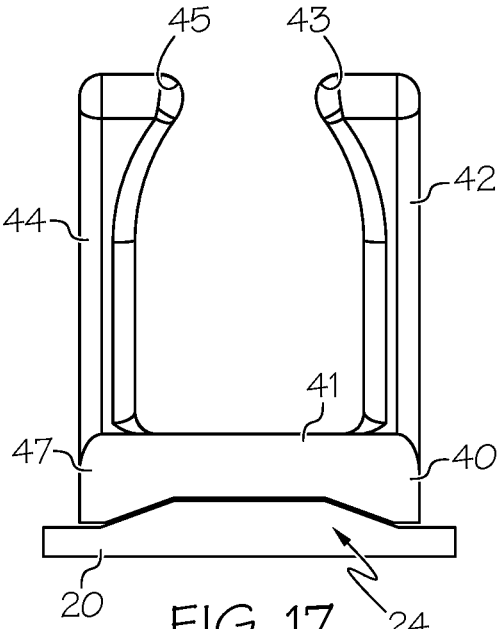

FIG. 17 also shows an embodiment of a supporting surface 24 of the rail 20. In some embodiments, the base 47 of the arrow rest 40 and the supporting surface 24 comprise complimentary shapes. In some embodiments, arrow rest 40 and the supporting surface 24 comprise complimentary V-shaped structures that provide for self-alignment between the rail 20 and arrow rest 40. In some embodiments, the base 47 comprises declining surfaces that are arranged to abut inclining surfaces on the supporting surface. In some embodiments, the components are arranged to self-alignment as disclosed between the rail and prod in U.S. Pat. No. 9,341,430, the entire content of which is hereby incorporated herein by reference.

FIGS. 19-22 show another embodiment of a crossbow 10. In some embodiments, a crossbow 10 comprises an arrow rest 40 and a location of the arrow rest 40 is adjustable. In some embodiments, the position of the arrow rest 40 is continuously variable along a length of the shooting axis 22.

In some embodiments, the rail 20 comprises a supporting surface 24 that is arranged to support the arrow rest 40. In some embodiments, the supporting surface 24 comprises a plurality of attachment locations 60. In some embodiments, the supporting surface 24 comprises a slot 64 that extends along a length portion of the rail 20. In some embodiments, a fastener 51 that attaches the arrow rest 40 to the rail 20 is oriented in the slot 64. In some embodiments, the arrow rest 40 can be attached to the rail 20 anywhere along the length of the slot 64.

In some embodiments, the arrow rest 40 is attached to the supporting surface 24 using a fastener 51 and a nut 52. In some embodiments, the fastener 51 and nut 52 clamp the body portion 41 of the arrow rest 40 against the supporting surface 24.

Figure 18:
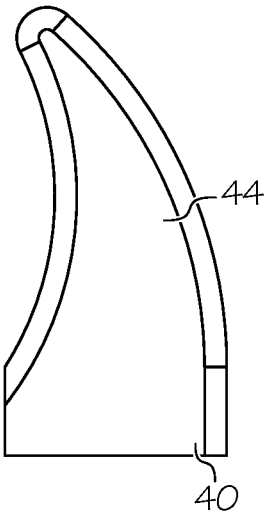
Figure 19:
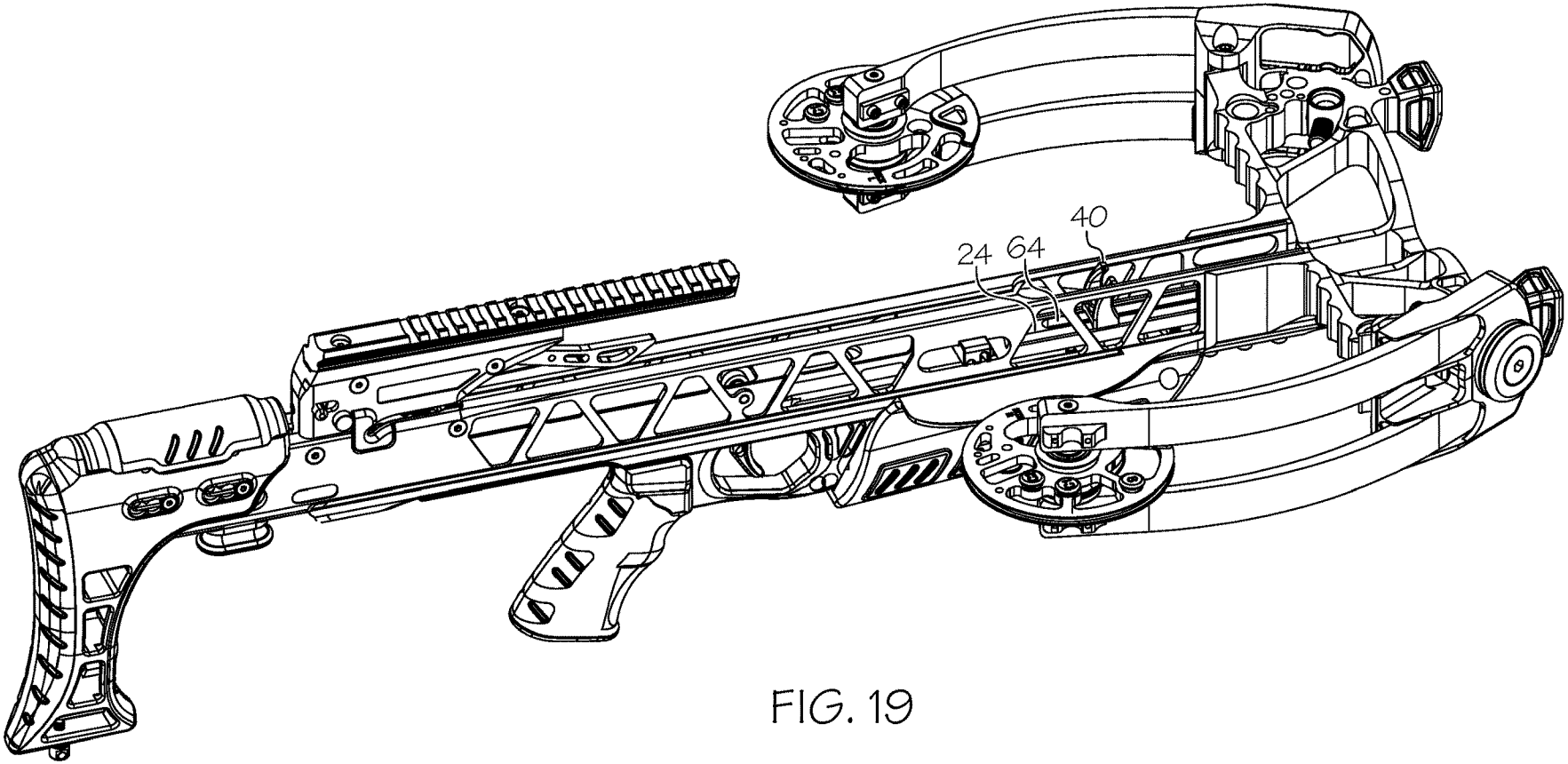
FIG. 19 shows another embodiment of a crossbow.
Figure 20:
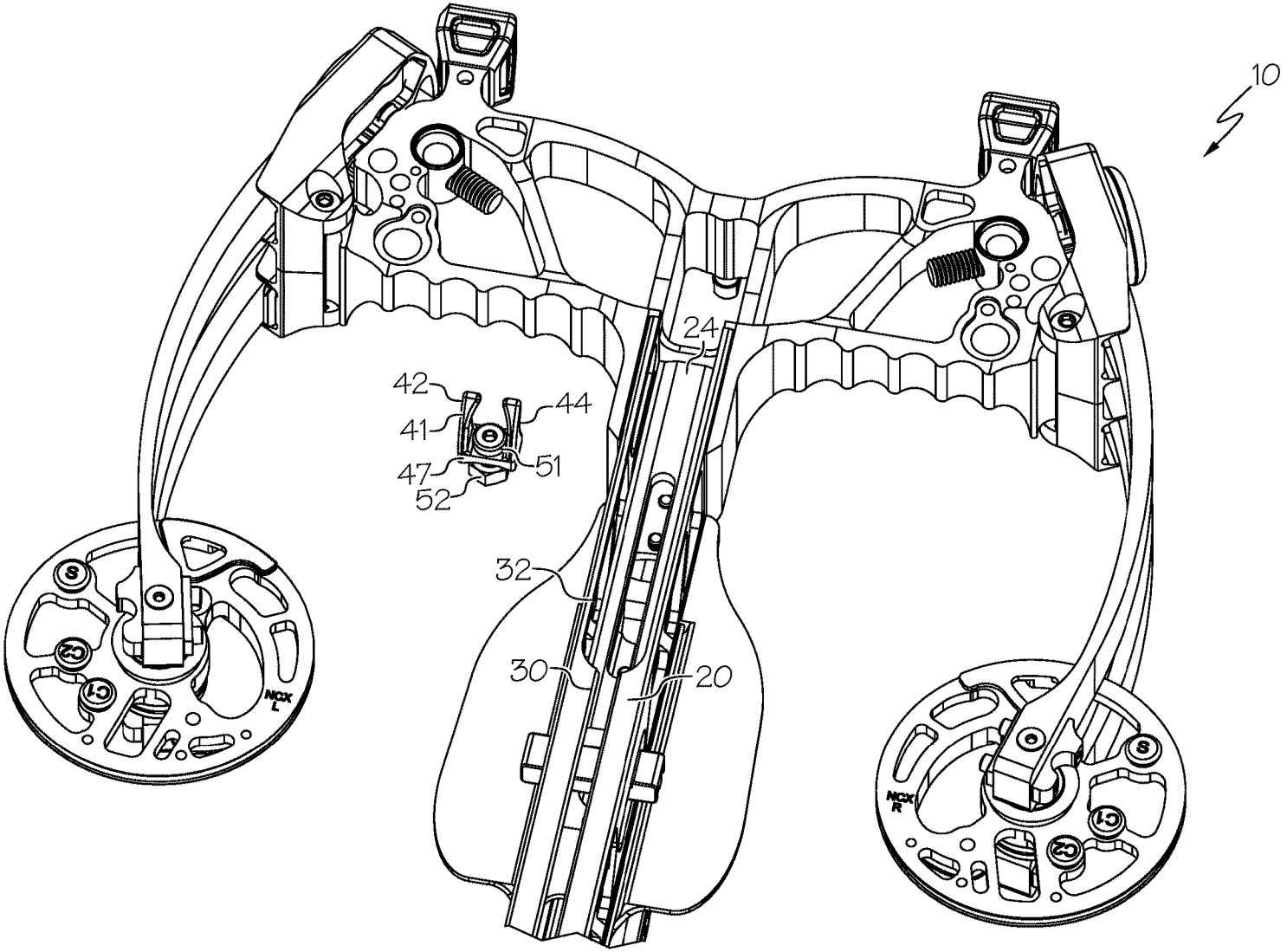
FIGS. 20 and 21 show the crossbow of FIG. 19 with an embodiment of an arrow rest removed from the crossbow.
Figure 21:
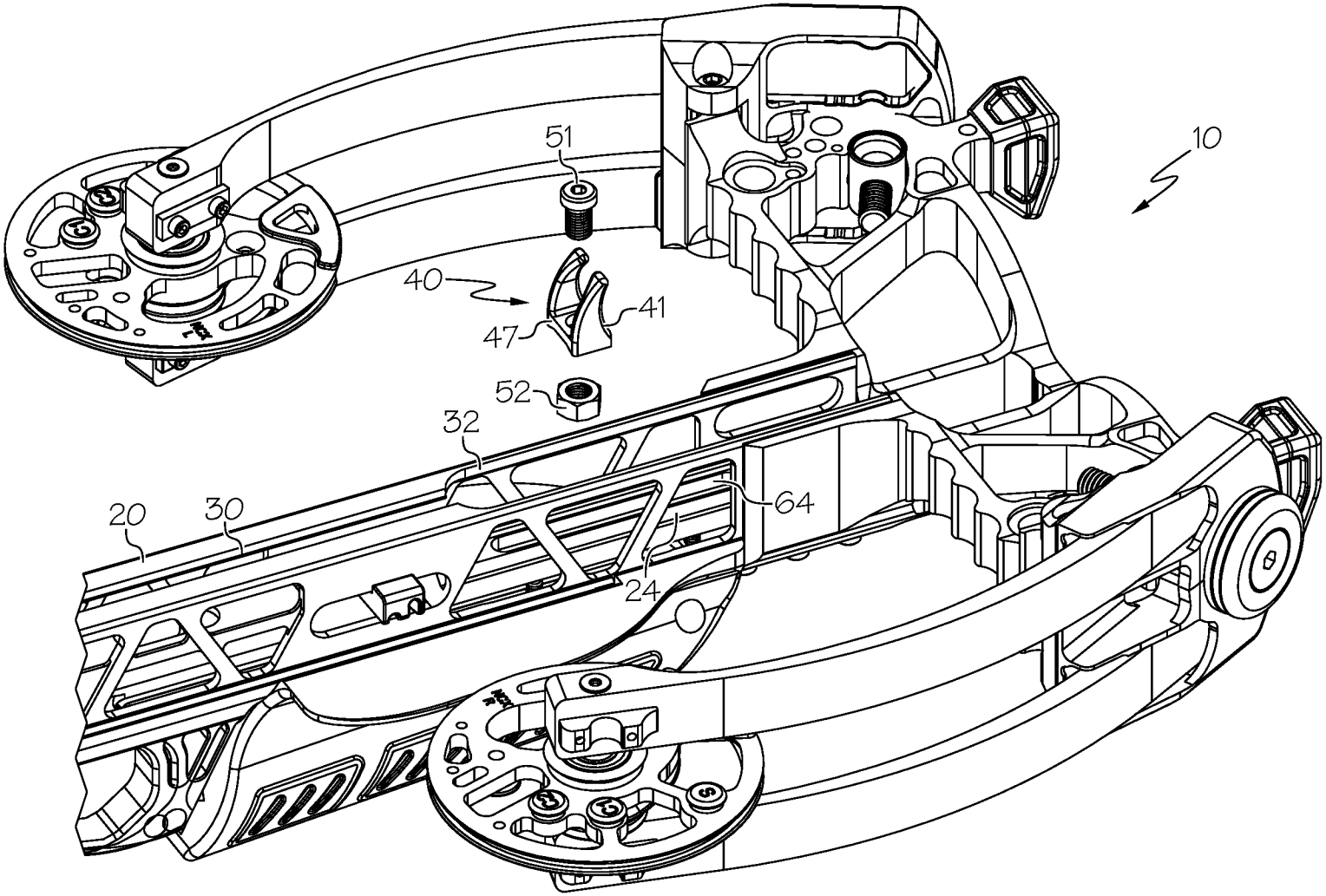
Figure 22:
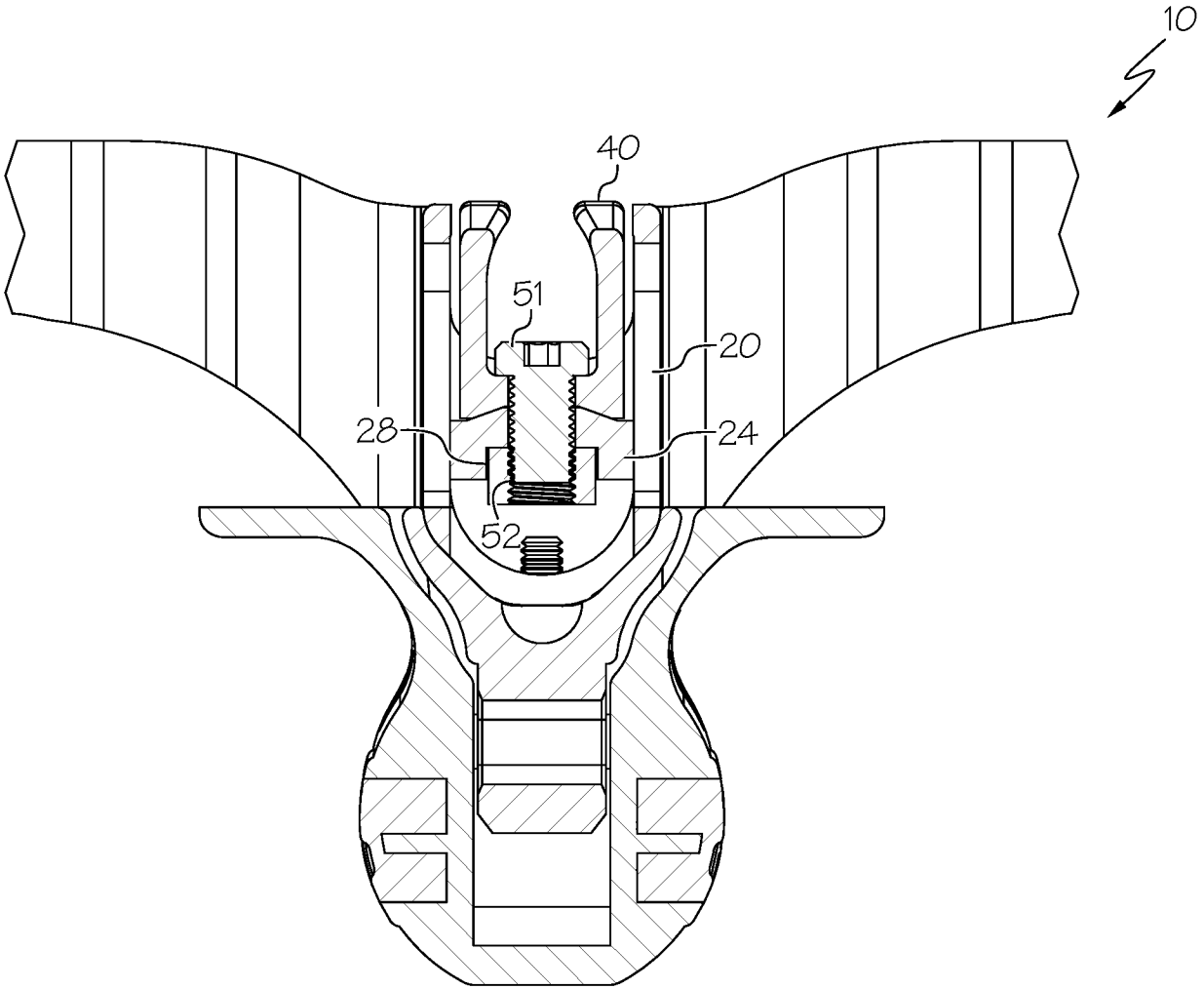
FIG. 22 shows a cross-sectional view of the crossbow of FIG. 19.

FIG. 22 shows a sectional view of the crossbow 10 of FIG. 18. In some embodiments, the rail 20 comprises a channel 28. In some embodiments, the channel 28 is constructed and arranged to engage the nut 52. For example, the nut 52 can be sized to fit in the channel 28, and flat sides of the nut 52 can abut sides of the channel 28. In some embodiments, the channel 28 braces the nut 52 against rotation and eases installation of an arrow rest 40. In some embodiments, a channel 28 is formed in the supporting surface 24.

In various embodiments, a rail 20 can be made using any suitable method. In some embodiments, the rail 20 is extruded and then machined. In some embodiments, a supporting surface 24 of the rail 20 is formed as the rail 20 is extruded.

In some embodiments, a crossbow 10 supports an arrow at a forward arrow support location 74 and a rear arrow support location 76. In some embodiments, the rear arrow support location 76 comprises a bowstring 26, for example near the latch 14 in a drawn/cocked configuration. In some embodiments, the forward arrow support location 74 comprises an arrow rest 40. In some embodiments, the forward arrow support location 74 is moveable along a length of the crossbow 10.

Desirably, the crossbow 10 can be configured for use with different arrows, which may have different characteristics. For example, an arrow rest 40 can be used at a first location with a first type of arrow and the arrow rest 40 can be used at a second location with a second type of arrow. The types of arrows can differ in any suitable way, for example having different lengths, weights, materials, tips, etc. In some embodiments, a first arrow type and first arrow rest 40 location can be configured to optimize short range hunting ability, while a second arrow type and second arrow rest 40 location can be configured to optimize long range target accuracy.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a frame comprising a groove;

a bow portion comprising a bowstring;

a latch;

a trigger; and an arrow rest supported by the frame at a first location, the frame arranged to support the arrow rest at a second location, a distance between the latch and the first location being different from a distance between the latch and the second location, the arrow rest comprising a first fastener and a second fastener, the first location comprising a first aperture and a second aperture arranged on opposite sides of the groove, the first fastener engaged with the first aperture and the second fastener engaged with the second aperture.

2. The crossbow of claim 1, the first aperture comprising helical threads, the second aperture comprising helical threads.

3. The crossbow of claim 1, the groove comprising a first portion having a first width and a second portion having a second width, wherein the first location and the second location overlap with the second portion along a length of the frame.

4. The crossbow of claim 1, the second location comprising a third aperture and a fourth aperture arranged on opposite sides of the groove.

5. The crossbow of claim 1, comprising a spacer oriented between the first fastener and the frame.

6. A crossbow comprising:

a frame comprising a groove, the frame comprising a first location comprising a first pair of apertures located on opposite sides of the groove, the frame comprising a second location comprising a second pair of apertures located on opposite sides of the groove;

a bow portion comprising a bowstring;

a latch;

a trigger; and an arrow rest comprising a pair of supports, the pair of supports engaged with the first pair of apertures at the first location, the pair of supports arranged for engagement with the second pair of apertures at the second location.

7. The crossbow of claim 6, the frame comprising a top flange, the apertures formed in the top flange.

8. The crossbow of claim 6, the first pair of apertures comprising a first aperture and a second aperture, the pair of supports comprising a first support and a second support, the first support comprising a first portion and a second portion, the first portion comprising a first supporting surface, the second portion oriented in the first aperture.

9. The crossbow of claim 8, the second support comprising a first portion and a second portion, the first portion comprising a second supporting surface, the second portion oriented in the second aperture.

10. The crossbow of claim 8, comprising a spacer oriented between the first support and the frame.

11. The crossbow of claim 10, the spacer comprising a washer.

12. The crossbow of claim 6, the first pair of apertures comprising screw threads.

13. The crossbow of claim 12, the second pair of apertures comprising screw threads.

14. The crossbow of claim 12, the pair of supports comprising a pair of fasteners.

15. The crossbow of claim 13, the fasteners comprising screw threads.

16. A crossbow comprising:

a frame comprising a groove, the frame comprising a first aperture and a second aperture located on opposite sides of the groove;

a bow portion comprising a bowstring;

a latch;

a trigger; and an arrow rest comprising a first fastener and a second fastener, the first fastener engaged with the first aperture and the second fastener engaged with the second aperture, the first fastener comprising a first supporting surface, the second fastener comprising a second supporting surface.

17. The crossbow of claim 16, the first fastener comprising screw threads.

18. The crossbow of claim 16, the first aperture and the second aperture comprising a first location, the frame comprising a second location comprising a third aperture and a fourth aperture, the first fastener arranged for engagement with the third aperture, the second fastener arranged for engagement with the fourth aperture.

19. The crossbow of claim 18, the frame comprising a third location comprising a fifth aperture and a sixth aperture.

20. The crossbow of claim 16, comprising a spacer oriented between the first fastener and the frame.

* * * * *